US007412179B2

(12) United States Patent
Yoo et al.

(10) Patent No.: US 7,412,179 B2
(45) Date of Patent: Aug. 12, 2008

(54) WET-TYPE ELECTROPHOTOGRAPHIC IMAGE FORMING APPARATUS AND METHOD FOR CONTROLLING COLLECTION OF DEVELOPER

(75) Inventors: Sang-hun Yoo, Seongnam-si (KR); Sung-tack Byun, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 83 days.

(21) Appl. No.: 11/155,626

(22) Filed: Jun. 20, 2005

(65) Prior Publication Data

US 2006/0045553 A1 Mar. 2, 2006

(30) Foreign Application Priority Data

Aug. 27, 2004 (KR) ..... 10-2004-0067986

(51) Int. Cl.
*G03G 15/10* (2006.01)

(52) U.S. Cl. ..... 399/57

(58) Field of Classification Search ..... 399/57
See application file for complete search history.

(56) References Cited

U.S. PATENT DOCUMENTS 6,694,112 B2 * 2/2004 Sasaki et al. ..... 399/57
2005/0053398 A1 * 3/2005 Kim et al. ..... 399/237

FOREIGN PATENT DOCUMENTS

JP 03-033778 2/1991
JP 03-121480 5/1991
JP 09-80909 3/1997

* cited by examiner

*Primary Examiner*—David M. Gray
*Assistant Examiner*—David A Blackshire
(74) *Attorney, Agent, or Firm*—Roylance, Abrams, Berdo & Goodman, L.L.P.

(57) ABSTRACT

A wet-type electrophotographic image forming apparatus includes a development unit for developing an image on a photosensitive medium, a developer cartridge for supplying a developer to the development unit, a developer collection unit disposed between the development unit and the developer cartridge for collecting developer remaining within the development unit into the developer cartridge, and a control unit for controlling the amount of developer to be collected through the developer collection unit to prevent an overflow of the developer at the developer cartridge while the developer is collected. A method for collecting developer remaining in a development unit into a developer cartridge in a wet-type electrophotographic image forming apparatus comprises the steps of turning on a pump to supply developer to the development unit, collecting developer remaining in the development unit in both a natural manner and a compulsory manner. The compulsory collection is controlled to prevent developer from overflowing in the developer cartridge when a printing operation is terminated or an error occurs during the printing operation.

23 Claims, 5 Drawing Sheets

WET-TYPE ELECTROPHOTOGRAPHIC IMAGE FORMING APPARATUS AND METHOD FOR CONTROLLING COLLECTION OF DEVELOPER

CROSS-REFERENCE TO RELATED APPLICATIONS

This application claims the benefit under 35 U.S.C. § 119 (a) of Korean Patent Application No. 2004-67986, filed on Aug. 27, 2004 in the Korean Intellectual Property Office, the entire disclosure of which is hereby incorporated by reference.

BACKGROUND OF THE INVENTION

1. Field of the Invention

The present invention generally relates to a wet-type electrophotographic image forming apparatus that uses a liquid developer. More particularly, the present invention relates to a wet-type electrophotographic image forming apparatus having a system for collecting residual developer from a development unit into a developer cartridge and a method for controlling the amount of collected developer.

2. Description of the Related Art

Generally, electrophotographic image forming apparatuses can be classified as either dry-type image forming apparatuses that use a dry powder developer or wet-type image forming apparatuses that use a liquid developer. Dry-type and wet-type image forming apparatuses each have distinctive characteristics. Generally, wet-type image forming apparatuses have better print quality, with higher definition and resolution, than dry-type image forming apparatuses. As digital cameras have become more popular, the demand for color image forming apparatuses has greatly increased. They have especially increased demand for printers that produce high resolution, natural-color, prints.

To produce a desired level of print quality with a wet-type image forming apparatus, it is necessary to provide a developing unit with a larger amount of developer than the amount actually required for printing. For this reason, excess, unused developer is collected and returned to a developer cartridge. FIG. 1 schematically illustrates a conventional wet-type electrophotographic image forming apparatus that provides and collects developer.

In the apparatus shown in FIG. 1, when a user enters a printing instruction, a supply pump (not illustrated) starts to supply developer to a development unit 16 from a developer cartridge 15. When the development unit 16 is filled with developer to a certain level, the developer starts to collect naturally. That is, any excess developer returns to the developer cartridge 15 by exiting a developer outlet 17, entering into a drain 18, and flowing into the developer cartridge 15, due to gravity. While printing continues, the supply of developer by the supply pump and the natural collection of the developer occur concurrently. As a result, the development unit 16 maintains an adequate level of developer.

When printing is terminated, or, when printing stops due to an error in the middle of the printing process, a collection pump 12 is activated to collect the developer and return the developer through connection tube 13. Since the natural collection of the developer continues to take place, the developer collects into the developer cartridge 15 more rapidly. After the collection of the residual developer is completed, the collection pump 12 is stopped and, thus, the developer collection is terminated.

However, when the collection pump 12 operates, developer is returned to the developer cartridge through both drain 18 and connection tube 13. This simultaneous bi-directional inflow of the developer causes the level of developer contained within the developer cartridge 15 to increase. This increased level of developer causes air within the developer cartridge 15 to compress. The compressed air leaks out of the drain 18, creating an airflow 20 in the opposite direction of developer flow. This causes the developer to overflow and contaminate various interior parts of the electrophotographic image forming apparatus. In addition to the contamination, the overflowing developer causes malfunctions. Furthermore, the overflowing developer may leak out of the apparatus, causing severe contamination outside of the apparatus.

Accordingly, there is a need for an improved apparatus for returning excess developer in a wet-type electrophotographic image forming apparatus, and a wet-type electrophotographic image forming apparatus employing the same.

SUMMARY OF THE INVENTION

An aspect of the present invention is to solve at least the above problems and/or disadvantages and to provide at least the advantages described below. Accordingly, an aspect of the present invention is to provide a wet-type electrophotographic image forming apparatus that is capable of adjusting the collection amount of developer that flows into a developer cartridge in the course of collecting the developer, and a method for controlling the collection amount of the developer.

In accordance with one aspect of the present invention, a wet-type electrophotographic image forming apparatus includes a development unit for developing an image on a photosensitive medium. A developer cartridge supplies developer to the development unit. A developer collection unit is disposed between the development unit and the developer cartridge to collect any developer remaining within the development unit and return the developer to the developer cartridge. A control unit controls the amount of the developer collected through the developer collection unit to prevent overflow of the developer at the developer cartridge while the developer is collected.

Preferably, the developer collection unit includes a drain providing a developer flow passage for allowing developer remaining in the development unit to be collected into the developer cartridge naturally, and a pump for forcefully collecting developer into the developer cartridge.

Preferably, the pump supplies and collects the developer by rotating either forward or backward. The control unit controls the pump by comparing the amount of developer collected by the pump and the amount of the developer naturally collected. Furthermore, the control unit controls the pump by using pulse width modulation (PWM).

In accordance with another aspect of the present invention, a method for collecting a developer remaining in a development unit into a developer cartridge in a wet-type electrophotographic image forming apparatus includes the steps of turning on a pump to supply developer to the development unit, collecting developer remaining in the development unit in a natural manner, collecting developer in a compulsory manner, and controlling the amount of the compulsorily collected developer when a printing operation is terminated or an error occurs during the printing operation.

Preferably, the step of collecting the developer in a compulsory manner includes the steps of turning off a pump to stop developer supply to the development unit, and collecting the developer by rotating the pump in a backward direction.

The step of collecting the developer remaining in the development unit in a compulsory manner preferably further includes the step of collecting the developer by adjusting the duty cycle of the pump. It is also preferable that the step of collecting the remaining developer further includes the step of stopping the pump from operating for a predetermined period after the developer supply is stopped.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENT

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
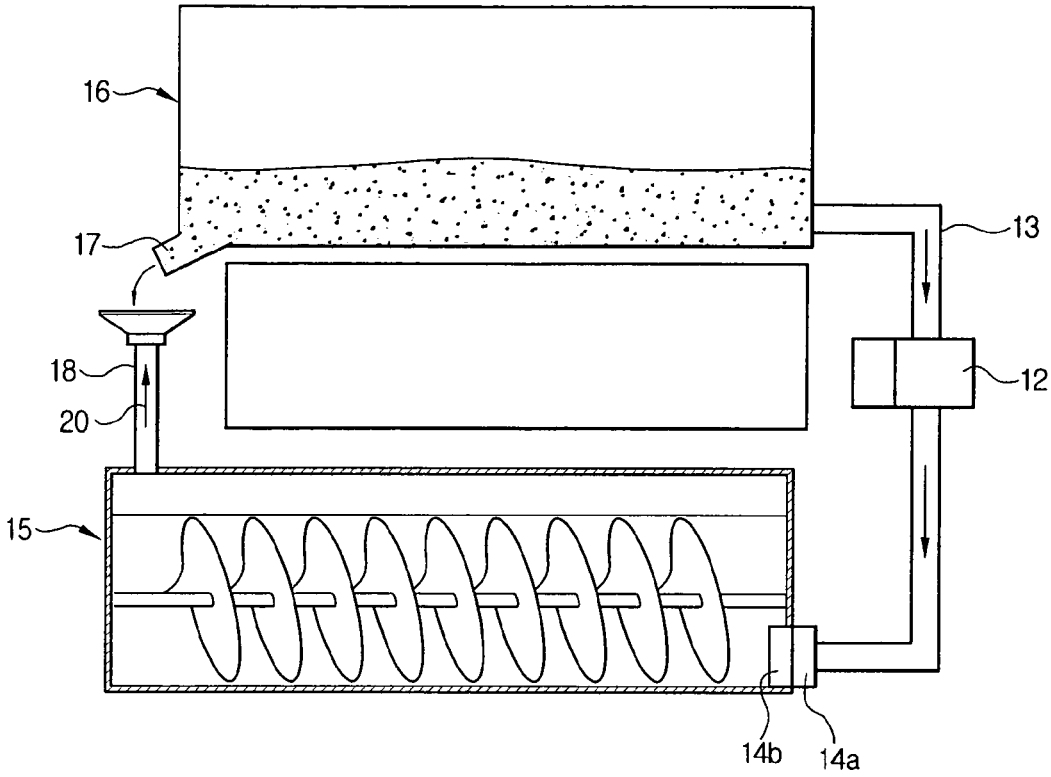
FIG. 1 (PRIOR ART)
FIG. 1 is a schematic view of a conventional wet-type electrophotographic image forming apparatus.
Figure 2:
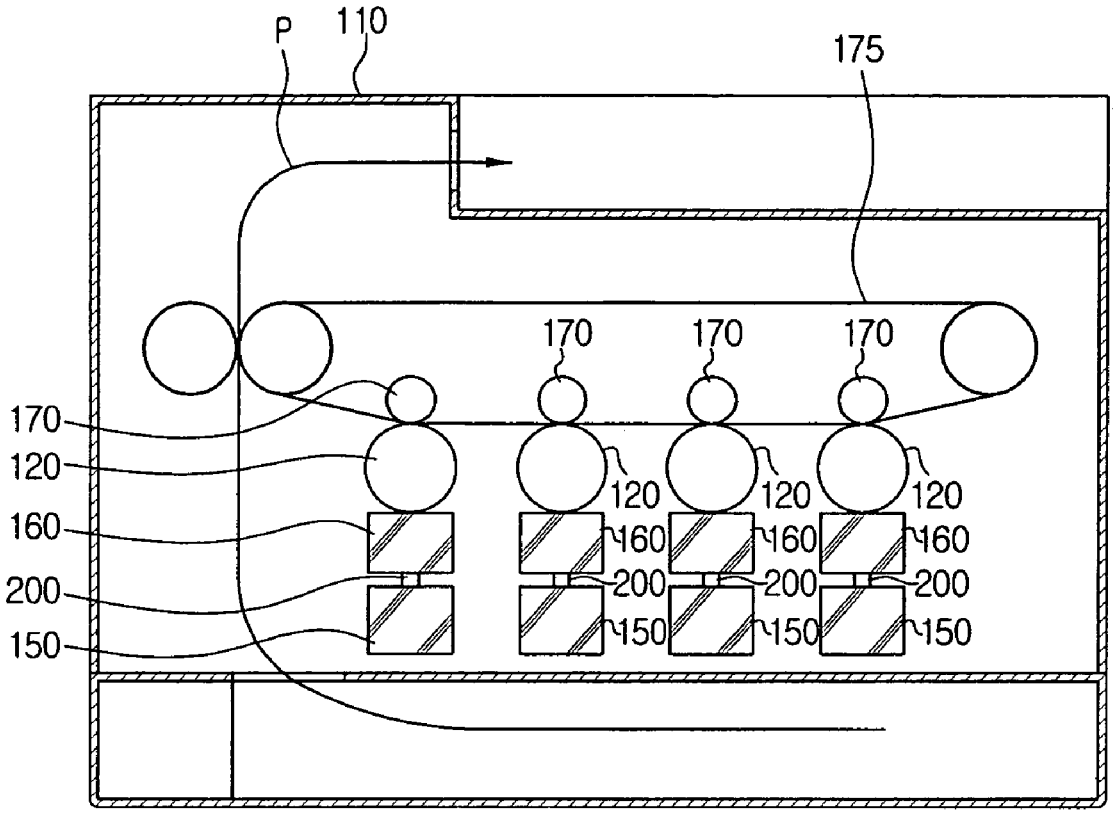
FIG. 2 is a schematic view of a wet-type electrophotographic image forming apparatus in accordance with an embodiment of the present invention.
Figure 3:
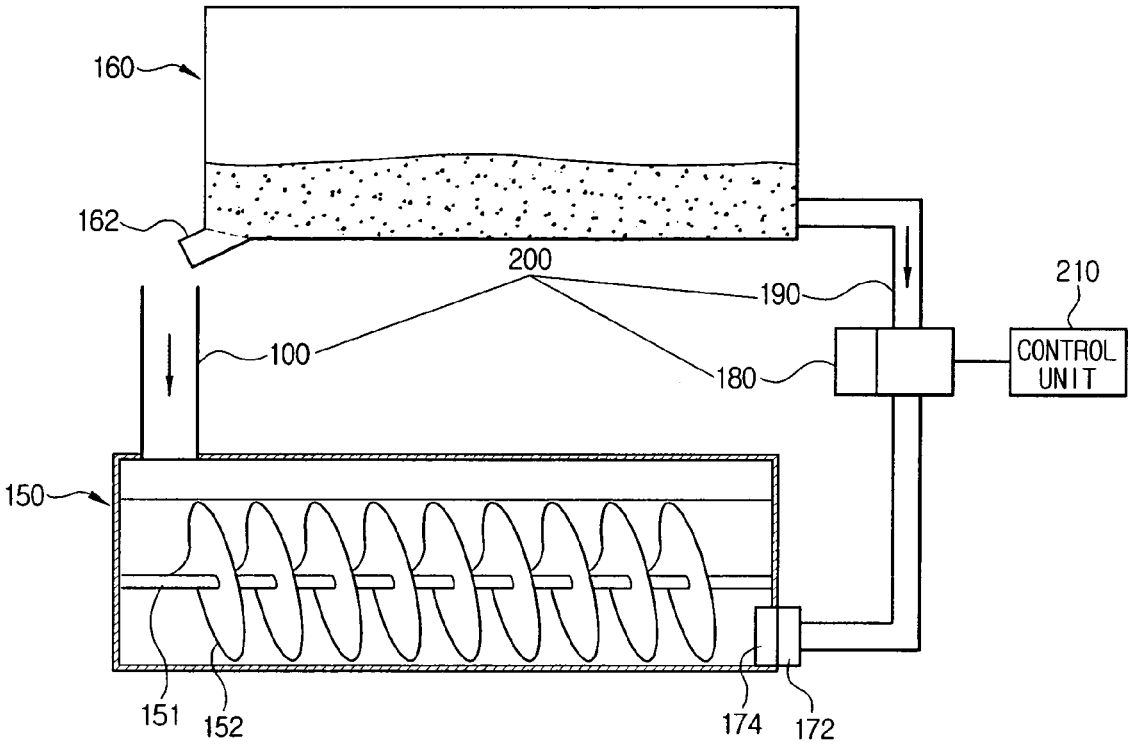
FIGS. 3 and 4 are schematic views of the main parts of the wet-type electrophotographic image forming apparatus as shown in FIG. 2.

FIG. 2 is a diagram illustrating the configuration of a wet-type electrophotographic image forming apparatus in accordance with an embodiment of the present invention. FIG. 3 illustrates the main components of the wet-type electrophotographic image forming apparatus shown in FIG. 2.

Referring to FIG. 2, the wet-type electrophotographic image forming apparatus includes a main body 110, a plurality of development units 160 for generating an image by supplying a developer to photosensitive medium 120, a plurality of developer cartridges 150 containing the developer, a plurality of developer collection units 200, and a control unit 210 (FIG. 3). The main body 110 holds the development units 160, the developer cartridges 150, the developer collection units 200, and the control unit 210. The image forming apparatus also includes an intermediate transfer belt 175 and backup rollers 170 for transferring an image onto the intermediate transfer belt 175 from the photosensitive medium 120. Paper travels through the image forming apparatus along a printing paper transfer path P.

Referring to FIGS. 2 and 3, the development unit 160 is placed above the developer cartridge 150 and generates an image by transferring developer to the photosensitive medium 120. The developer supplied to the development unit 160 from the developer cartridge 150 generates an image on the photosensitive medium 120, and residual developer is collected into the developer cartridge 150. At the bottom of the development unit 160, there is an outlet 162. Developer freely falls through the outlet 162 (by gravity) and is subsequently collected into the developer cartridges 150.

The developer cartridge 150 is filled with developer. The developer cartridge 150 supplies developer to the development unit 160 and collects residual developer from the development unit 160. An agitator 152 rotating around a shaft 151 is installed inside the developer cartridge 150. The agitator 152 prevents the developer supplied to the development unit 160 from solidifying.

The developer collection unit 200 is disposed between the development unit 160 and the developer cartridge 150, and collects residual developer in the development unit 160 into the developer cartridge 150. The developer collection unit 200 includes a drain 100, a pump 180 and a connection tube 190.

The drain 100 is connected with the developer cartridge 150, and provides a natural collection passage where developer flowing out of the outlet 162 runs down to the drain 100 by free fall during the printing process. The connection tube 190 is connected with the development unit 160, the developer cartridge 150, and the pump 180. The connection tube 190 provides a passage for developer collected by the pump 180. A male fitting unit 172 and a female fitting unit 174 are disposed at the connection site between the connection tube 190 and the developer cartridge 150 to maintaining a substantially fluid-tight seal.

The pump 180 is connected with the connection tube 190 to cause developer to flow. Preferably, the pump 180 can rotate in both forward and backward directions. As mentioned above, the pump 180 supplies the developer from the developer cartridge 150 to the development unit 160 during the printing process. In addition, the pump 180 functions as a collection pump for collecting developer from the development unit 160 during the termination of a printing process. That is, the pump 180 rotates in a forward direction to supply developer to the development unit 160 from the developer cartridge 150 and, conversely, rotates in a backward direction to collect developer from the development unit 160 into the developer cartridge 150.

An H-bridge circuit is preferably used to control the forward and backward rotations of the pump 180 with a single power source.

The exemplary embodiment of the invention described herein uses a dual function pump (that is, the same pump is used to both supply and collect developer). Wet-type electrophotographic image forming apparatuses, however, are not limited to dual function pumps. It is possible to install separate supply and collection pumps, and use the control unit 210 to control the separate supply and collection pumps. With separate pumps, however, if the collection pump stops operating for any reason, such as by breaking, the supply pump continues to operate. Thus, the developer may overflow. Accordingly, it is preferable that one pump is used to both supply and collect developer.

The control unit 210 controls the amount of developer to be collected into the developer cartridge 150 to prevent any overflow that may happen at the developer cartridge 150 during developer collection. In particular, the control unit 210 uses pulse width modulation (PWM) control to operate the pump.

PWM is typically used to control motors and other power sources. PWM controls power by adjusting the duty cycle of a pulse signal and reduces unnecessary power consumption. For example, when a resistor is used to slow down the pumping speed of the pump 180, there is unnecessary power consumption. In contrast, the use of a switching device for controlling the pumping speed through turning on and off the switching device controls the pumping speed without unnecessary power consumption. The ratio of 'ON' to 'OFF' is referred to as the duty cycle, and is commonly expressed as percentage (%). The pumping speed increases as the width of the 'ON' signal increases. Conversely, the pumping speed decreases as the width of 'ON' decreases. Thus, by controlling the pulse width to control the pump 180, the control unit 210 limits the power supplied to the pump 180 and reduces unnecessary power consumption.

In other words, PWM controls the pumping speed by controlling the duty cycle. Therefore, the control unit 210 adjusts the duty cycle through PWM control, and, thus, adjusts the amount of the developer to be collected by the pump 180. As a result of this adjustment, the control unit 210 is capable of controlling the developer so that it does not overflow the drain 100 of the developer cartridge 150.

Figure 4:
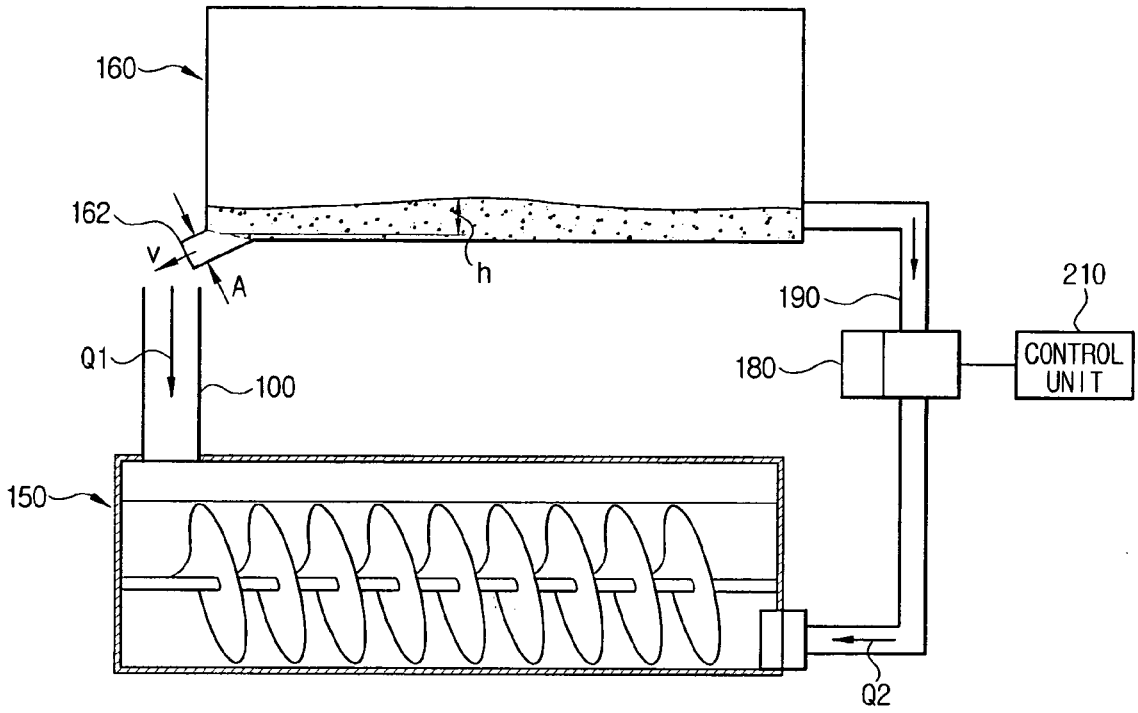

With reference to FIG. 4, a method for setting the duty cycle for controlling the collection amount of the developer to prevent overflow of the developer at the drain 100 will be described in detail. FIG. 4 illustrates both the natural collection passage through which developer is naturally collected into the developer cartridge 150 and the compulsory collection passage through which developer is compulsorily collected by the pump 180.

First, Q1 is defined as the amount of developer that is naturally collected, that is, the amount of developer collected from the development unit 160 into the developer cartridge 150 through the outlet 162. In short, Q1 is the amount of developer collected per unit time. Assuming that A is the cross-sectional area of the outlet 162 and v is the speed of the developer flowing out of the outlet 162, Q1 is determined by the following equation.

$$Q1=v\cdot A \qquad \text{[Equation 1]}$$

Assuming that h is the average height from the outlet 162 to the top surface of the developer contained in the development unit 160, v can be obtained in accordance with Torricelli's theorem, which is defined as:

$$v=(2gh)^{1/2} \qquad \text{[Equation 2]}$$

This equation is theoretical. In reality, however, the outlet orifice has a certain friction. Hence, assuming that the efflux coefficient is c, $$v=c(2gh)^{1/2} \qquad \text{[Equation 2']}$$

The efflux coefficient is variable depending on the shape of an outlet. When the outlet has a circular shape, the efflux coefficient ranges from approximately 0.93 to approximately 0.98.

Substituting Equation 2' into Equation 1, the following relationship is established as:

$$Q1=c(2gh)^{1/2}\cdot A \qquad \text{[Equation 3]}$$

Meanwhile, when it is assumed that the amount of developer collected into the developer cartridge 150 per unit time by the pump 180 is expressed as Q2, the following equation is produced:

$$Q2=\beta\cdot\gamma\cdot Pwm. \qquad \text{[Equation 4]}$$

In Equation 4, β is a maximum capacity of the pump 180 per unit time, γ is a control constant based on the driving force of the pump 180, and Pwm is a pumping speed factor. The control constant γ is different depending on the pump type and specifications.

When the maximum amount of the developer that can flow into or flow out of the developer cartridge 150 through the drain 100 per unit time is assumed to be Q3, Q3 has a predetermined constant value, which can be expressed by the following equation.

$$Q3=\eta \qquad \text{[Equation 5]}$$

To prevent overflow of developer at the drain 100, Q3 should be greater than the added value of the Q1 and the Q2. This relationship can be defined according to Equations 3 to 5 and, expressed as follows.

$$\eta>c(2gh)^{1/2}\cdot A+\beta\cdot\gamma\cdot Pwm \qquad \text{[Equation 6]}$$

As a result, the pumping speed factor Pwm is determined as follows.

$$Pwm<(\eta-c(2gh)^{1/2}\cdot A)/(\beta\cdot\gamma) \qquad \text{[Equation 7]}$$

This Equation 7 represents the PWM determination equation. The duty cycle of the pump 180 for preventing overflow of developer at the drain 100 should be determined based on this PWM determination equation.

The change in volume of developer due to temperature changes also need to be considered to accurately determine the PWM. The relationship between change in the volume of the fluid and change in temperature is proportional and can be expressed as $\Delta V\propto\Delta T$. The change in the volume of the fluid ΔV causes the height of the fluid to increase, and the height h measured from the top surface of the developer to the outlet 162 varies depending on the shape of a developing unit 160. Hence, the change in volume caused by temperature change gives rise to a change in height, that is, Δh, between the top surface of the developer and the outlet. As a result, it is necessary to consider the shape of the development apparatus.

Figure 5:
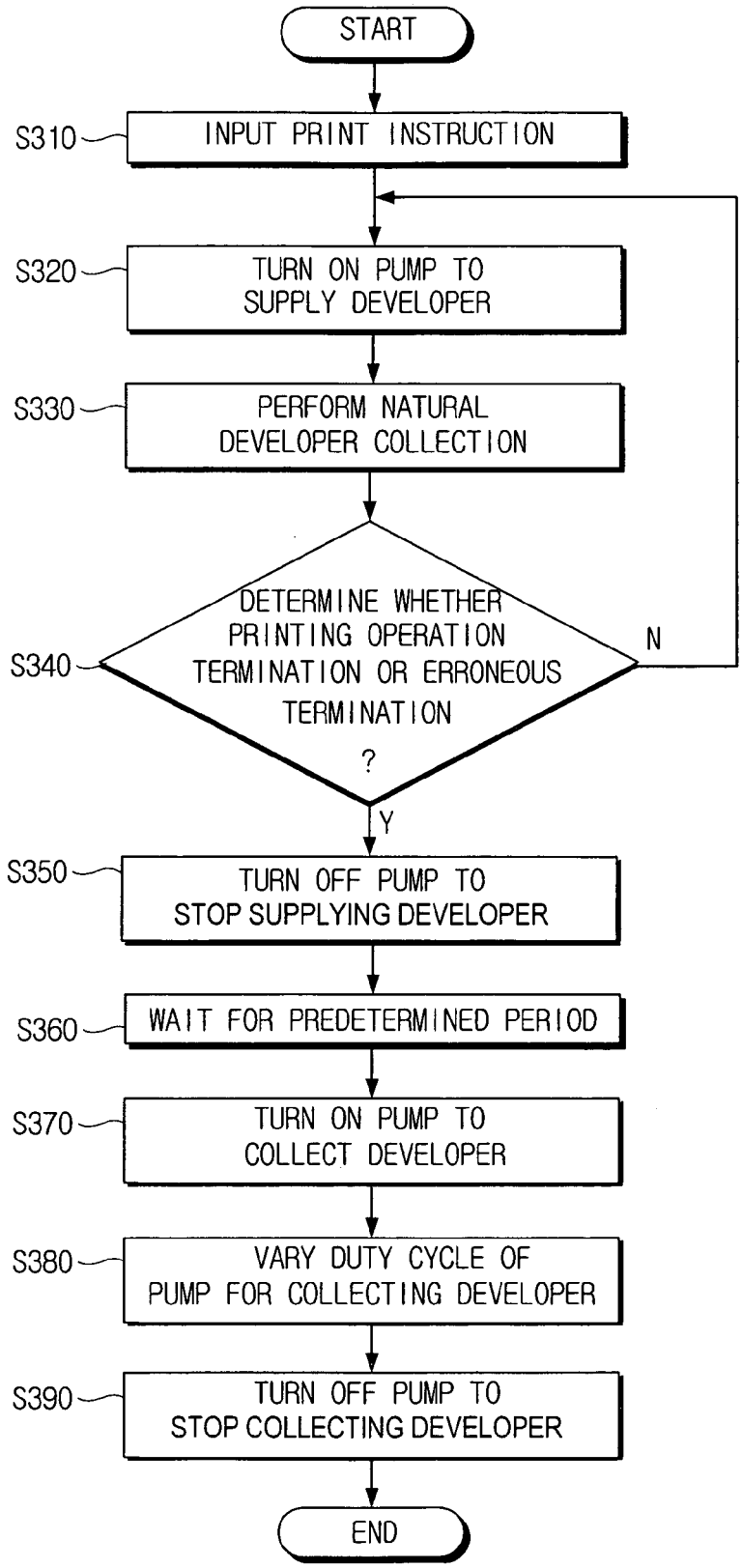
FIG. 5 is a flowchart of the method of controlling the collection of developer in accordance with the embodiment of the present invention.

With reference to FIGS. 3 to 5, the operation of the disclosed exemplary embodiment wet-type electrophotographic image forming apparatus with the above-described configuration will be explained in detail.

At step S310, the printing process starts when a user inputs a print instruction. At step S320, the pump 180 is turned on, and developer starts to be supplied from the developer cartridge 150 to the development unit 160. At this time, when the developer reaches a predetermined level of the development unit 160, natural developer collection is initiated at step S330. While the printing process continues, the developer supply executed by the pump 180 and the natural collection of developer through the outlet 162 occur simultaneously, so that the developer contained inside of the development unit 160 is maintained in an appropriate level.

As step S340, when the printing process is terminated or the printing process stops because of an error arising in the middle of the printing process, the pump 180 is turned off at step S350. The pump 180 is held in standby by being turned off for a predetermined time t at step S360. In this standby state, the natural collection of developer continues. Thus, the amount of developer contained inside the development unit 160 is reduced. The reason for placing the pump 180 in standby is to prevent an abrupt increase of developer flow into the developer cartridge 150 due to sudden collection of developer by the pump 180.

When some amount of developer contained inside the development unit 160 is collected through natural collection, the pump 180 rotates backward to proceed with compulsory collection of the developer into the developer cartridge 150 from the development unit 160 at step S370. At step S380, the control unit 210 varies the duty cycle of the pump to allow developer remaining in the development unit 160 to be compulsorily collected into the developer cartridge 150 without causing developer to overflow at the drain 100. When all the developer is collected, the pump 180 is turned off at step S390, thus terminating developer collection.

As explained above, the amount of developer that is collected by the pump 180 is controlled to prevent a sudden collection of developer into the developer cartridge 150. As a result, it is possible to prevent overflow of developer caused by sudden collection of the developer. Accordingly, the disclosed wet-type electrophotographic image forming apparatus operates more stably.

While the invention has been shown and described with reference to certain embodiments thereof, it will be understood by those skilled in the art that various changes in form and details may be made therein without departing from the spirit and scope of the invention as defined by the appended claims.

What is claimed is:

1. A wet-type electrophotographic image forming apparatus, comprising:

a development unit for developing an image on a photosensitive medium;

a developer cartridge for supplying developer to the development unit;

a developer collection unit disposed between the development unit and the developer cartridge for collecting developer remaining within the development unit into the developer cartridge, wherein the developer collection unit includes a drain providing a developer flow passage for allowing developer remaining in the development unit to be collected into the developer cartridge in a natural manner, and a pump for collecting developer in the development unit and pumping developer into the developer cartridge in a compulsory manner; and a control unit for controlling the amount of developer passing through the developer collection unit from the development unit to prevent an overflow of developer at the developer cartridge while the developer is collected, wherein the control unit controls the pump based on the amount of compulsorily collected developer and the amount of naturally collected developer.

2. The wet-type electrophotographic image forming apparatus of claim 1, wherein the pump supplies and collects the developer by a forward rotation and a backward rotation.

3. The wet-type electrophotographic image forming apparatus of claim 1, wherein the control unit controls the pump using pulse width modulation (PWM).

4. The image forming apparatus of claim 1, wherein said development collection unit further comprises:

said drain defining a passage between the development unit and the developer cartridge to allow developer in the developing unit to flow by gravity into the developer cartridge; and a collection tube extending between the development unit and the developer cartridge for supplying toner to the development unit and for carrying toner from the development unit to the developer cartridge.

5. The image forming apparatus of claim 4, further comprising a dual direction pump in the collection tube for selectively supplying toner to the development unit or supplying toner to the developer cartridge.

6. The image forming apparatus of claim 5, wherein the control unit controls the operation of the pump to prevent overflow of the toner from the developer cartridge.

7. The image forming apparatus of claim 1, wherein the drain allows the developer to drain into the developer cartridge by gravity.

8. The wet-type electrophotographic image forming apparatus of claim 1, wherein said developer collection unit further comprises:

a first flow passage extending between the developer cartridge and the developer collecting unit for allowing developer in the development unit to pass into the developer cartridge by gravity;

a second flow passage extending between the developer cartridge and the developer collection unit; and a pump for pumping developer through the second flow passage between the developer cartridge and the developer collection unit, wherein the control unit controls the pump to prevent overflow of the developer in the developer cartridge.

9. The wet-type electrophotographic image forming apparatus of claim 8, wherein the control unit controls the pump based on the amount of developer collected in the developer cartridge by gravity and the amount of developer collected in the developer cartridge by the pump.

10. A method for collecting developer remaining in a development unit into a developer cartridge in a wet-type electrophotographic image forming apparatus, the method comprising the steps of:

turning on a pump to supply developer from the developer cartridge to the development unit;

collecting developer remaining in the development unit and directing the developer to the developer cartridge in a natural manner;

collecting developer in the developer cartridge in a compulsory manner, and controlling the compulsory collection to pump developer from the developer unit to the developer cartridge and controlling the pump to prevent developer from overflowing the developer cartridge when a printing operation is terminated or an error occurs during the printing operation, wherein the pump is controlled based on the amount of developer collected in the developer cartridge in the natural manner and the amount of developer pumped to the developer cartridge.

11. The method of claim 10, wherein the step of collecting the developer remaining in the development unit in the compulsory manner comprises the sub-steps of:

turning off a pump to stop a developer supply to the development unit; and collecting the developer by rotating the pump in a backward direction.

12. The method of claim 11, further comprising the sub-step of stopping the pump from operating for a predetermined period after the developer supply is stopped.

13. The method of claim 11, further comprising the sub-step of collecting the developer by adjusting a duty cycle of the pump.

14. The method of claim 13, wherein the step of the collecting developer remaining in the development unit in a natural manner includes the steps of allowing developer to flow out of the development unit through an outlet, and collecting the developer into the developer cartridge through a drain.

15. The method of claim 13, wherein the duty cycle of the pump is adjusted based on the equation:

$$Pwm<(\eta-c(2gh)^{1/2}\cdot A)/(\beta\cdot\gamma),$$

where $\eta$ is the maximum amount of developer that can flow into or flow out of the developer cartridge through the drain, c is the efflux coefficient for the drain, g is gravity, h is the height of developer in the development unit, A is the cross-sectional area of the outlet, $\beta$ is a maximum capacity of the pump per unit time, γ is a control constant based on the driving force of the pump, and Pwm is a pumping speed factor.

16. The method of claim 10, wherein said apparatus includes a collection tube between the developer cartridge and the development unit, and where the pump selectively pumps the developer to the development unit and to the developer cartridge, the method comprising:

controlling the pump to prevent overflow of developer in the developer cartridge.

17. The method of claim 16, wherein the apparatus further includes a drain for draining developer from the development unit to the developer cartridge by gravity.

18. A wet-type electrophotographic image forming apparatus, comprising:

a development unit for developing an image on a photosensitive medium;

a developer cartridge for supplying developer to the development unit;

a drain providing a developer flow passage for allowing developer remaining in the development unit to be collected into the developer cartridge in a natural manner;

a collection tube extending between the developer cartridge and the development unit;

a pump for collecting developer in the development unit and pumping the developer through the collection tube to the developer cartridge in a compulsory manner; and a control unit for controlling the pump to prevent developer from overflowing the developer cartridge during developer collection and for controlling the pump based on the amount of developer collected in the developer cartridge in the natural manner and the amount of developer collected in the developer cartridge in the compulsory manner.

19. A wet-type electrophotographic image forming apparatus according to claim 18, wherein the control unit uses pulse width modulation to control the pump.

20. A wet-type electrophotographic image forming apparatus according to claim 18, wherein the development unit has an outlet.

21. A wet-type electrophotographic image forming apparatus according to claim 20, wherein the control unit adjusts the duty cycle of the pump based on the equation:

$$Pwm<(\eta-c(2gh)^{1/2}\cdot A)/(\beta\cdot\gamma),$$

where η is the maximum amount of developer that can flow into or flow out of the developer cartridge through the drain, c is the efflux coefficient for the drain, g is gravity, h is the height of developer in the development unit, A is the cross-sectional area of the outlet, β is a maximum capacity of the pump per unit time, γ is a control constant based on the driving force of the pump, and Pwm is a pumping speed factor.

22. The image forming apparatus of claim 18, wherein the developer passes through the flow passage to the developer cartridge by gravity.

23. The image forming apparatus of claim 22, wherein the pump is a dual directional pump, and where the control unit selectively controls the pump to direct developer to the development unit and to the developer cartridge.

* * * * *